United States Patent [19]

Hamer

[11] 4,175,549

[45] Nov. 27, 1979

[54] BED FOR PATIENTS

[76] Inventor: Geerd Hamer, Vorm Heiligen Kreuz 15, 6108 Weiterstadt, Fed. Rep. of Germany

[21] Appl. No.: 828,280

[22] Filed: Aug. 29, 1977

[30] Foreign Application Priority Data

Aug. 31, 1976 [DE] Fed. Rep. of Germany ..... 2639072

[51] Int. Cl.[2] ..... A61H 1/00

[52] U.S. Cl. ..... 128/24 R; 128/70

[58] Field of Search ..... 128/24 R, 70, 68, 69, 128/33; 5/DIG. 2, 351, 352, 91

[56] References Cited

U.S. PATENT DOCUMENTS

| | | | |
|---|---|---|---|
| 1,978,223 | 10/1934 | Parker | 128/70 |
| 2,532,425 | 12/1950 | Schenker | 5/91 |
| 3,656,190 | 4/1972 | Regan | 128/33 |
| 3,999,234 | 12/1976 | Regan | 5/DIG. 2 |
| 4,085,738 | 4/1978 | Kodera | 128/70 |

*Primary Examiner*—Lawrence W. Trapp

[57] ABSTRACT

A bed is divided into a large number of individual polygonal lying surfaces, each of which is spatially adjustable in height and angle of inclination in relation to the others. The patients's weight pushes the lying surfaces downward against a spring and the patient's body sets the inclination angle of the lying surfaces. A rack and gear locking device locks the height through an external rod and a rack and gear locking device locks the inclination through an internal rod connected to the lying surfaces through a socket-expandable ball arrangement on its upper end. The lying surfaces in the head area of the bed have holes and perforations.

14 Claims, 3 Drawing Figures

BED FOR PATIENTS

This invention relates to a bed for medical purposes whose lying area is divided into partial lying areas whose spatial position relative to each other can be varied and fixed in any position.

Such patient beds are, e.g., massage beds and operation beds.

With an ordinary massage, the massage bed is the only tool of the doctor besides his hands. The relaxing support for the patient, not too soft, but also not too hard, besides the skill of the masseur has a considerable influence on the success of the massage. The wider the massage bed, the harder it is for the masseur "to reach over" because of the resultant lever action. The narrower a bed, the more uncomfortable it is for a patient with a broad structure. A very difficult problem is the positioning of the head of the patient when he looks to the side or downward if the back is to be massaged. Further problems result that with the face down and low, the patient has difficulty breathing. The section between head and body portion of the known beds is inelastic. For patients of different heights one should really have beds of different lengths. During the back massage, the knee joints should be slightly bent which is achieved at present by a foam filled roll. Another problem is presented by the frequently large breasts of older women which women patients frequently find uncomfortable when in the prone position. From a medical viewpoint, this is even dangerous particularly with a powerful massage.

Also, it is very difficult to achieve a stable side position on such beds. For operations this is accomplished in a cumbersome manner by surrounding the patient with pillows and sand bags so that the patient cannot escape the hands of the surgeon.

It is the object of this invention to provide a bed of the above type which permits the stable posturing of the patient independent of his weight, his height and his other body characteristics so that the masseur or surgeon can work effectively and to make the posture as comfortable as possible to the patient.

This object of the invention is achieved as follows.

(a) The major portion of the patient bed is divided into a large number of polygons which form the partial lying surfaces.

(b) Each polygon is individually adjustable in its vertical position against the force of a power storage.

(c) The angle of each polygon can be adjusted individually.

(d) There is an elevation locking device.

(e) There is an inclination locking device.

This makes it possible for the patient to have the bed fit him, i.e., the surface of the lying surface does not only adapt itself superficially to his body contours; rather, the bed in the fitted state represents a type of rough plaster cast if the locking devices have been acutated. This locking is necessary because the masseur requires a solid support under the body of the patient to give a good massage. Otherwise he pushes and massages "into the void." The solution to this problem offered by the invention is optimal and inexpensive. It offers to all patients, masseurs, and surgeons, particularly in the orthopedic area during the massage of crippled patients, great aid and expands the therapeutic possibilities.

The polygonal lying surfaces are regular hexagons. This improvement provides that, roughly, one has round partial surfaces, because a hexagon in first approximation represents a circle, but there is not excessively large space in corner areas which would be the case if the partial surfaces were made round.

The polygonal lying surfaces measure 6 to 8 cm across. With these dimensions it turned out that they are optimal in relation to the body shapes of most patients and one does not require too many polygons which would be the case if triangles were used.

The polygonal lying surfaces have breathing holes in a head area of the bed. Because of this improvement, the patient can breath easily even if the nose and mouth are facing downward.

The polygonal lying surfaces in the head area are perforated. Because of this improvement, breathing is further facilitated and the patient does not have to be afraid of being dependent on relatively few breathing holes.

Helical spring means provides the power storage. Because of this improvement, large spring travels are combined with constant spring characteristic and space-saving construction.

The elevation locking device comprises universal joints having one part fastened to the underside of the polygonal lying surfaces and a rod which moves up and down and has a portion at its upper end which forms part of the universal joint. Because of these improvements, the up and down mobility is combined with the inclinability.

The rod can be locked via a gear drive. Because of these improvements, simple locking is achieved.

The rod has a gear rack in the direction of motion. Because of these improvements, the locking device can be easily made to act on the elevation adjustment device.

The universal joint is a ball-and-socket/baseplate socket joint. Because of these improvements, there results a particularly simple universal joint known from photographic tripods, et. so that familiar techniques can be used.

The ball is expansible for inclination locking. Because of this improvement, a very simple locking results. Again, the techniques known from photographic tripods can be used.

Inside the rod there is another rod with up and down movement which later rod during its upward movement expands the volume of the expansible ball outwardly. Because of this improvement, there is a simple nested arrangement of elevation/inclination locking devices.

All elevation locking means can be actuated simultaneously. Because of this improvement, it is possible to instantly fix the position most favorable before the patient moves to undesirable positions. The same applies to the following improvement: All inclination locking means can be actuated simultaneously.

A mechanical embodiment is described by means of the drawing.

Figure 1:
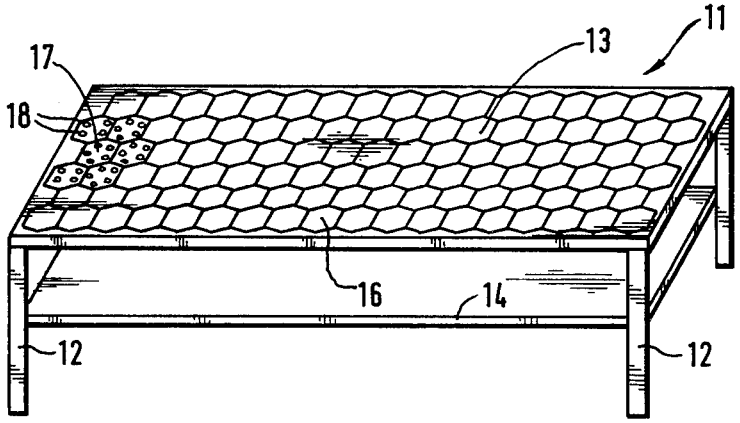
FIG. 1 shows a simplified perspective view of the bed.

A bed 11 stands on four legs 12. On top it has a lying surface 13 which in the unloaded condition forms a plane; underneath it has a rigid bottom 14. The lying surface 13 is divided into a large number of hexagonal plates 16 which border one another and whose elevation and inclination can be changed with respect to each other. In the patient head area 17, nine hexagonal plates 16 have a number of holes 18 which serve as breathing holes.

Figure 2:
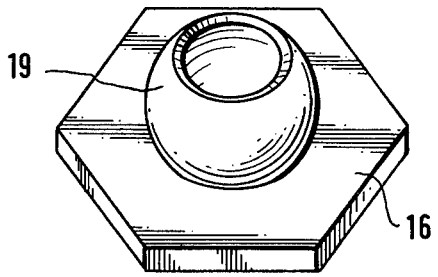
FIG. 2 shows a bottom view of a regular hexagon.
Figure 3:
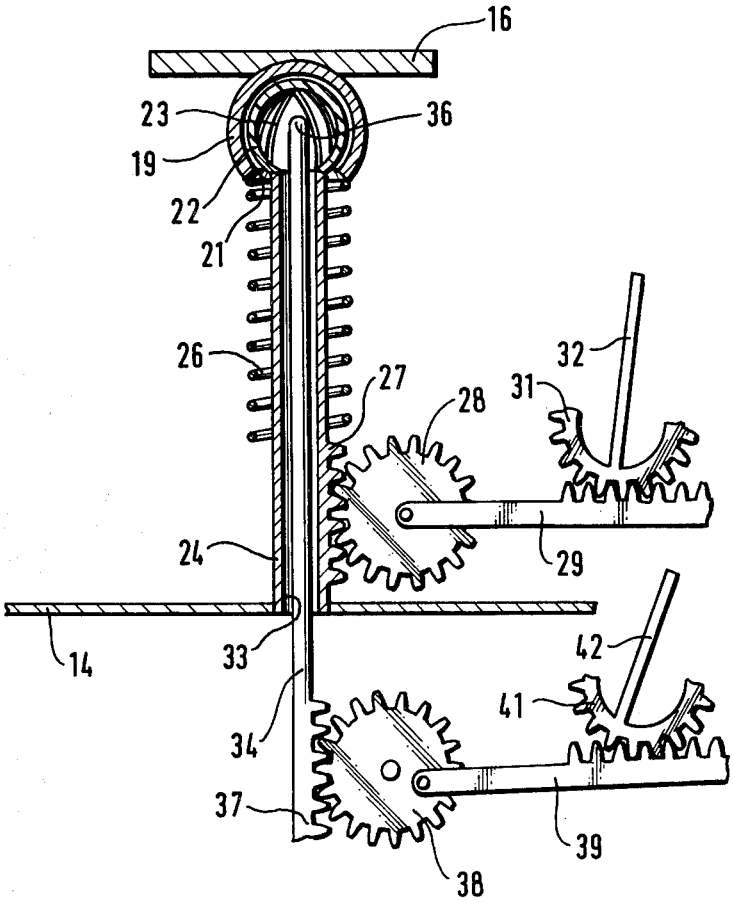
FIG. 3 shows a partial section through a hexagon with associate elevation adjusting device, inclination adjusting device, elevation locking device and inclination locking device.

As shown in perspective in FIG. 2, each hexagonal plate 16 has in its center a ball joint case 19 which on its downward side has a circular opening 21. The ball joint case 19 holds a ball-and-socket joint 22 which fits snugly into the ball-joint case 19 and has a number of radial slots 23. The ball-and-socket joint 22 is made of elastic material so that—when the slots 23 are spread in a manner to be described later—the ball-and-socket joint 22 is jammed in the ball joint case 19, regardless of the angle (Up to a certain amount) of the hexagonal plate 16.

The ball-and-socket joint 22 sits on top of a rod 24 made of steel and is held in the bottom 14 so that it can be moved up and down (by means not shown). The rod is enclosed by a helical spring 26 which on top braces against the ball joint case 19 and on the other side at least indirectly braces against the bottom (not shown) so that the hexagonal plates 16 are pushed upward.

If the patient lies on bed 11, the hexagonal plates 16 tilt till they are tangetial to the body region contacted. Also, downward projecting body portions push the hexagonal plates 16 at that location deeper than other body portions so that a body-contour mould develops.

Rod 24 at its lower portion has a gear rack 27. It engages a gear 28 which is mounted, but not rotatatable, to a horizontal gear rack 29. The gear rack 29 engages a gear rim 31 which can be moved about its axis of rotation by means of a lever 32. If the hexagonal plate 16 is in its desired position, lever 32 is pulled to the right, gear rack 29 moves to the left and the non-rotary gear 28 locks the gear rack 27 and thus rod 24.

Rod 24 has a center bore 33 in which an inside steel rod 34 moves up and down. The steel rod 34 passes through bottom 14. The upper end 36 of the steel rod extends into the ball-and-socket joint 22. At its lower end, the steel rod 34 has a gear rack 37. Facing it is a gear 38. This gear 38 can—after engaging gear rack 37—be turned by means of a gear rack 39, a toothed segment 41 engaging its teeth and a lever 42 attached thereto in such a way that the steel rod 34 moves upward and spreads the end 36 of ball-and-socket joint 22, and hence locks it in the inclined position.

The lying surface 13 need not be flat and even from the outset. Rather, this lying surface 13 in the foot area may be raised in the form of an embankment, from the start, for instance, unless a load is placed on it.

Of course, some or nearly all parts may also be actuated electromagnetically, i.e., the elevation locking device and the inclination locking device may be electromagnetic design by using electromagnetic-mechanical locking devices.

Also, equivalent hydraulic arrangements may be used where the helical spring 26 is replaced by a hydraulic pressure; rod 24 is the piston rod of a hydraulic piston, the steel rod 34 is replaced by direct hydraulic pressure or by a hydraulic piston rod, etc.

What is claimed is:

1. A bed comprising a substantial plurality of polygonal shaped lying surfaces dividing up and forming a major portion of the lying surface of the bed, which can be fixed in a wide range of spatial relation positions relative to each other to stably support and position the body portions of a user thereon, means including power storage means, for individually adjusting the vertical position of each polygonal lying surface against the force of the power storage, means for individually adjusting the angle of inclination of each polygonal lying surface, locking means for locking the elevation of the polygonal lying surfaces, and locking means for locking the inclination of the polygonal locking surfaces.

2. The bed according to claim 1 wherein the polygonal lying surfaces are regular hexagons.

3. The bed according to claim 2 wherein the polygonal lying surfaces measure 6 to 8 cm. across.

4. The bed according to claim 1 wherein the polygonal lying surfaces have breathing holes in a head area of the bed.

5. The bed according to claim 4 wherein the polygonal lying surfaces in the head area are perforated.

6. The bed according to claim 1 wherein helical spring means provides the power storage.

7. The bed according to claim 1 wherein the elevation locking device comprises universal joints having one part fastened to the underside of the polygonal lying surfaces and a rod which moves up and down and has a portion at its upper end which forms part of the universal joint.

8. The bed according to claim 7 comprising a gear drive, wherein the rod can be locked via the gear drive.

9. The bed according to claim 7 wherein the rod has a gear rack in the direction of motion.

10. The bed according to claim 7 wherein the universal joint is a ball-and-socket/baseplate socket joint.

11. The bed according to claim 10 wherein the ball is expansible for inclination locking.

12. The bed according to claim 11 wherein inside the rod there is another rod with up and down movement which latter rod during its upward movement expands the volume of the expansible ball outwardly.

13. The bed according to claim 1 comprising means for simultaneously actuating all elevational locking means.

14. The bed according to claim 1 comprising means for simultaneously actuating all inclination locking means.

* * * * *